United States Patent [19]

Royle

[11] Patent Number: 4,582,299

[45] Date of Patent: Apr. 15, 1986

[54] WINCHES WITH PULL CORD DRIVE

[76] Inventor: Ian A. Royle, 15 Vardon Ave., Beaumaris, 3193, Victoria, Australia

[21] Appl. No.: 616,828

[22] PCT Filed: Sep. 30, 1983

[86] PCT No.: PCT/AU83/00137

§ 371 Date: May 14, 1984

§ 102(e) Date: May 14, 1984

[87] PCT Pub. No.: WO84/01360

PCT Pub. Date: Apr. 12, 1984

[30] Foreign Application Priority Data

Sep. 30, 1982 [AU] Australia ..... PF6131

[51] Int. Cl.[4] ..... B66D 1/04; B66D 1/24

[52] U.S. Cl. ..... 254/345; 254/354; 254/359

[58] Field of Search ..... 254/364, 339, 345, 359, 254/364, 369, 346, 354, 371, 344, 342; 242/84.3

[56] References Cited

U.S. PATENT DOCUMENTS

| | | | |
|---|---|---|---|
| 17,715 | 6/1857 | Dunbar | 254/345 |
| 2,130,671 | 11/1937 | Maynes | 242/84.3 |
| 2,220,017 | 2/1939 | Maynes | 242/84.3 |
| 2,417,732 | 3/1947 | Bland et al. | 242/218 |
| 4,054,266 | 10/1977 | Guangorena | 254/354 |
| 4,483,518 | 11/1984 | Geschwind | 254/344 |

FOREIGN PATENT DOCUMENTS

| | | |
|---|---|---|
| 32576 | 7/1979 | Australia . |
| 58842 | 12/1980 | Australia . |
| 854697 | 11/1952 | Fed. Rep. of Germany . |

*Primary Examiner*—Stuart S. Levy
*Assistant Examiner*—Katherine Jaekel
*Attorney, Agent, or Firm*—Frishauf, Holtz, Goodman & Woodward

[57] ABSTRACT

A marine winch has a winch drum which is totally closed at the top, mounted on a base housing in bearings so as to rotate relative thereto on a vertical axis. The winch drum is driven in a given direction by pulling on a cord which is wound around a self-recoiling pulley in the base housing to thereby rotate the pulley and associated ratchet or clutch means and pinion gear which drives a gear ring on the winch drum. A sprag clutch is operatively connected between the winch and the base housing to prevent rotation of the winch drum in a direction opposite the given direction and to transmit load torque applied to the winch drum to a gear plate to automatically change gear ratios. An infinitely variable hydraulic drive means is also described.

15 Claims, 9 Drawing Figures

12
102
93
95
8A
89
8B
88
86
28
19
83
84
26
91
94
103
101
87
92
90
98
85
99
97
96
100
102
8A
8B
82
21
81
14

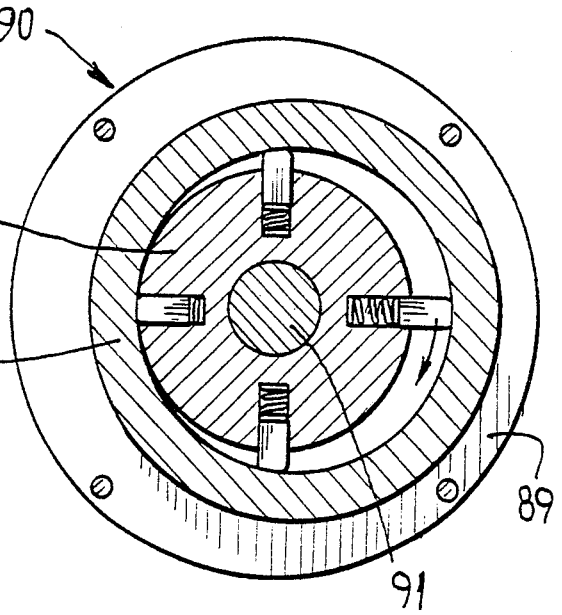
FIG. 8A.
FIG. 8B.
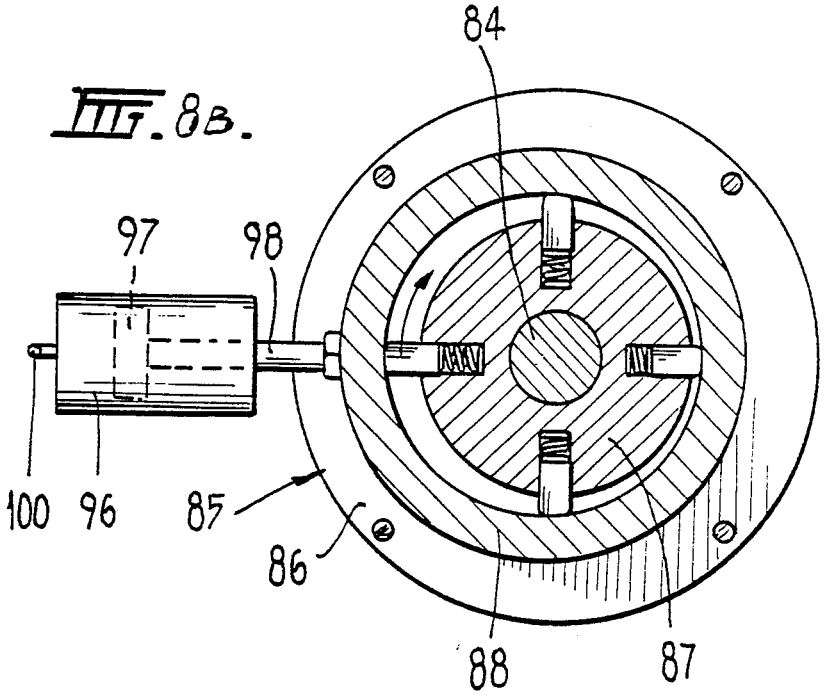

WINCHES WITH PULL CORD DRIVE

BACKGROUND OF THE INVENTION

This invention relates to improvements in winches and relates particularly to an improved winch construction adaptable for use on marine vessels, particularly sailing craft.

Winches are currently used on sailing craft of all types to facilitate the hauling of sheets, halyards and other tackle for the control of sail settings and the like. Hand operated winches generally have a ratchet mechanism operated by a handle which may be either fixed to the winch or removable therefrom. The handles on fixed lever winches often cause obstruction to crew movement and can also cause tangling of deck sheets. The fixed lever winches generally have a relatively short arc handle which either requires a relatively high gearing ratio to allow the necessary forces to be applied to the sheets or a relatively large turning force is required to operate the winch.

Winches having a removable handle generally have a handle of greater length than the short arc fixed lever handles to enable a larger turning force to be applied to the winch. However, the removable handles need to be able to be stored remotely from the winch which can result in handles being lost. Further, valuable time is sometimes lost in fitting the handles to the winch in the correct manner.

It is well known to provide winches with internal gearing, and clutch or ratchet mechanisms, to provide a mechanical advantage between movement of the operating lever or handle and rotation of the winch drum. Australian patent specification No. 429,190 discloses a three-speed deck winch wherein rotation of an input shaft by means of a handle in one direction results in selective engagement of internal gearing to drive the winch drum in a given direction at a first speed which is different to that when the input shaft is rotated in an opposite direction to cause operative engagement of second gearing, and a further engagement means enables the driving means for the input shaft to be directly coupled to the winch drum to drive the drum at a third speed. The direct coupling mode of this winch is manually selected so that pawls, pins, lugs or the like are moved to a position such that the handle or other driving means directly engages with the drum.

Australian patent specification No. 454,362 discloses a similar form of two-speed winch in which an operating handle on the top of the winch drives the winch drum, through gearing and clutch means located in the base of the winch to rotate the winch drum in a given direction at a first speed on rotation of the handle in a first direction and to rotate the winch drum at a second speed on rotation of the handle in the opposite direction. Specification No. 456,935, which is additional to No. 454,362, discloses a modified arrangement in which the input shaft may be directly coupled to the winch drum to provide an additional 1:1 gear ratio.

Australian patent specification No. 487,866 discloses a further arrangement of multi-speed winch in which a pawl is carried by the winch handle to directly couple the winch handle to the drum in an operative position and whereby, in an inoperative position, the winch handle drives the drum in a given direction at one of two speeds dependent on the direction of movement of the winch handle.

Australian patent specification No. 496,573 also discloses a multi-speed winch in which an idler gear, movable on a pivoted carrier, is able to be moved manually into engagement with a main shaft gear and a drum driving gear to drive the drum at a first speed on rotation of the winch handle. Reverse rotation of the handle automatically releases the idler gear from its engaged position and the winch drum is then driven at a second speed, or a third speed on further reverse of the handle rotation direction, by means of the gearing and associated clutches, etc., located in the base of the winch. The idler gear is moved by means of a lever mounted on the base of the winch.

The winches described in the prior art referred to above are all driven either by a handle mounted on the top of the winch and driving through an input shaft extending through the winch drum or, as shown in the Specification No. 429,190, through a pedestal arrangement which drives the input shaft by means of a chain and sprocket. The prior art winches are all, therefore, relatively expensive to manufacture due to the need to provide a multiplicity of internal seals and bearings which necessitate relatively expensive machining of the drum, shafts and other components.

Further, notwithstanding the use of seals, the prior art winches are susceptible to moisture entering the internal cavities of the winch resulting in corrosion and lack of durability of the winch. Further, the winches are operated by top-mounted handles which must be rotated in a particular direction for a desired gear ratio thus causing difficulty for the operator in providing the necessary circular motion to the handle.

It is desirable to provide an improved construction of winch which avoids some or all of the difficulties associated with the known handle operated winches.

It is also desirable to provide an improved construction of winch which has a sealed top to prevent the egress of moisture into the winching mechanism and which also obviates the need for a multiplicity of internal seals.

It is also desirable to provide an improved construction of winch which is relatively simple to operate and is economical and relatively cheap to manufacture.

SUMMARY OF THE INVENTION

In overcoming the problems of the prior art the present invention provides a marine winch comprising a base housing adapted to be secured to a support, a winch drum rotatably mounted on the base housing, a self-recoiling pulley means or sprocket mounted in said housing and having an operating cord or chain which passes through an opening in said base housing, a handle means on the free end of the operating cord or chain, drive means operative to interconnect said pulley means or sprocket with said winch drum to rotate said drum in a given direction on rotation of said pulley means or sprocket resulting from application of tension to said operating cord or chain, said drive means including a first ratchet or clutch means associated with said pulley means or sprocket permitting recoiling of said cord or chain, and second ratchet or clutch means operatively located between the winch drum and the base housing and permitting rotation of the winch drum in said given direction only.

The invention, in its simplest form, is applied to a single speed marine winch wherein the winch drum is mounted by suitable bearings on the base housing, the drum being closed across the top thereof and is provided with an internal gear adjacent the base of the drum. A self-recoiling pulley is rotatably mounted on a post extending upwardly from the base housing and a ratchet plate mounted on the self-recoiling pulley is drivingly connected to a unidirectional sprag clutch mounted on the post. The body of the sprag clutch is integral with a driving pinion meshed with the internal gear of the drum. A pair of spring loaded pawls mounted on the self-recoiling pulley engages appropriate teeth on the ratchet plate to enable drive from the pulley to be imparted to the clutch body.

Preferably, a cord is used to impart rotary motion to the pulley, the cord passing through a hole formed in one side of the base housing. As the cord is tensioned, the pulley rotates driving through the pawls and ratchet plate to the clutch body and the integral pinion thereby rotating the winch drum. On release of tension in the cord, the sprag clutch prevents reverse rotation of the winch drum and a spring located within the self-recoiling pulley causes the pulley to rewind the cord thereon.

With this type of winch construction, an appropriate gear ratio may be provided between the pinion and the internal gear to enable a predetermined tension on the operating cord to apply tension to a sheet engaged with the winch drum. As the operating cord is pulled generally in a straight line direction, the operator is able to brace himself to apply the necessary tension to the operating cord thus avoiding difficulties associated with the circular winding of a handle as is required with previous winches.

Because the winch drum is totally sealed on the top and is supported by internal bearings which are protected against the ingress of moisture by a relatively simple seal between the base of the winch drum and the top of the base housing, and by a further seal where the cord passes through the opening in the housing, the internal mechanism of the winch is substantially protected against corrosion and subsequent loss of durability and the like.

In an alternative form of the invention, a multiple gear ratio mechanism may be incorporated within the base housing and/or the winch drum. The particular ratio between movement of the operating cord and the winch drum can be manually selected or may be automatically selected dependent on the load applied to the winch drum. In one form of this embodiment of the invention, the desired ratio can be automatically selected by releasing strain on the operating cord thus allowing the load on the winch drum to be supported on a ratchet or sprag clutch which operates a spring loaded gear plate causing a load-affected movement of the gear plate to select the appropriate ratio for the next winching operation. Thus, the ratchet or sprag clutch arrangement is connected to a ratio change mechanism actuated in response to differential loading between the load on the winch drum and the preset spring loading. The greater the loading on the winch drum, the greater the ratio selected to enable movement to be imparted to the winch drum by the operating cord.

In a further modification of the invention, a hydraulic drive is effected between the self-recoiling pulley and the winch drum, the drive being sensitive to applied loads through variable fluid displacement in the hydraulic drive. With this arrangement, an essentially infinite variation of ratio may be obtained between rotation of the self-recoiling pulley and the winch drum.

The winch of the present invention allows a complete winching operation to be carried out with full gearing variation regardless of sheet loads, without reversing or remounting of handles, and the possible loss thereof, and with minimum effort of the operator. A further advantage of the present invention is that the operating cord can be pulled from any desired position and the body weight and bracing can be effectively used in a single direction rather than that which is necessary with circular winding as is the case with known winches.

In order that the invention will be more clearly understood, several embodiments thereof will now be described with reference to the accompanying drawings.

BRIEF DESCRIPTION OF THE DRAWINGS

FIGS. 8A and 8B are views taken along the lines 8A and 8B, respectively, in FIG. 7.

DESCRIPTION OF THE PREFERRED EMBODIMENT

Figure 1:
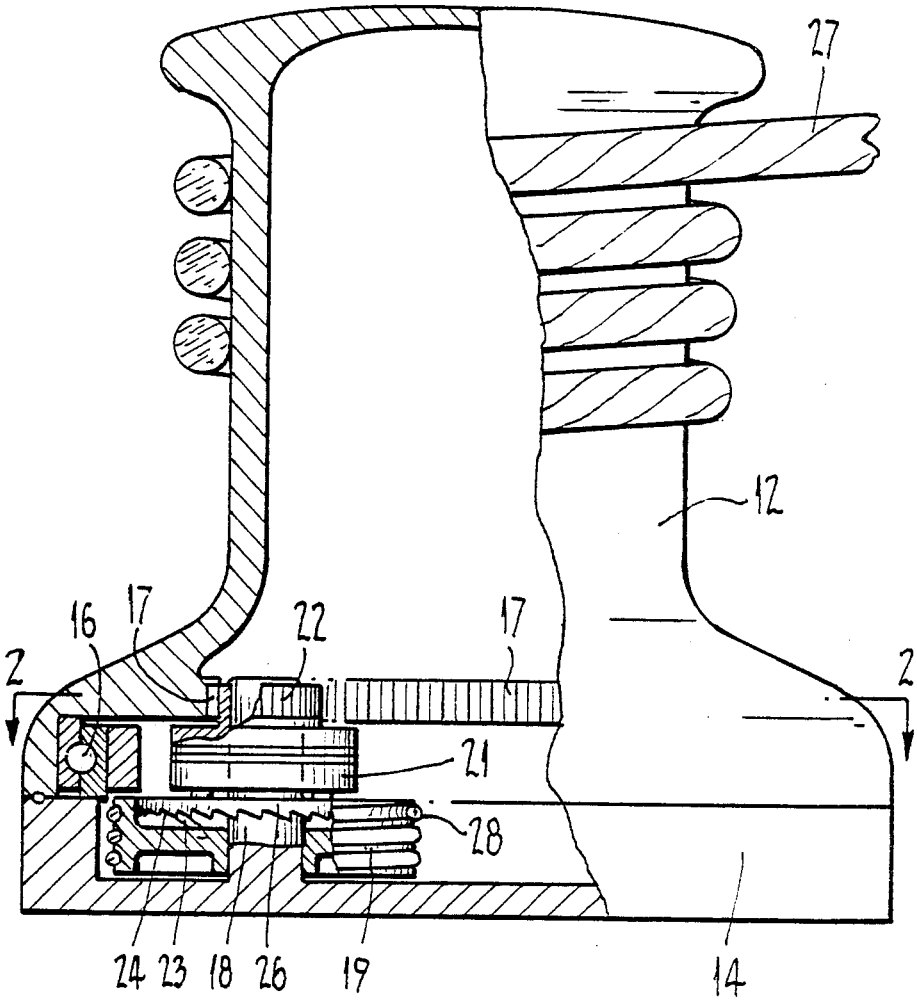
FIG. 1 is a part cross-sectional elevational view of a single speed winch in accordance with the present invention.
Figure 2:
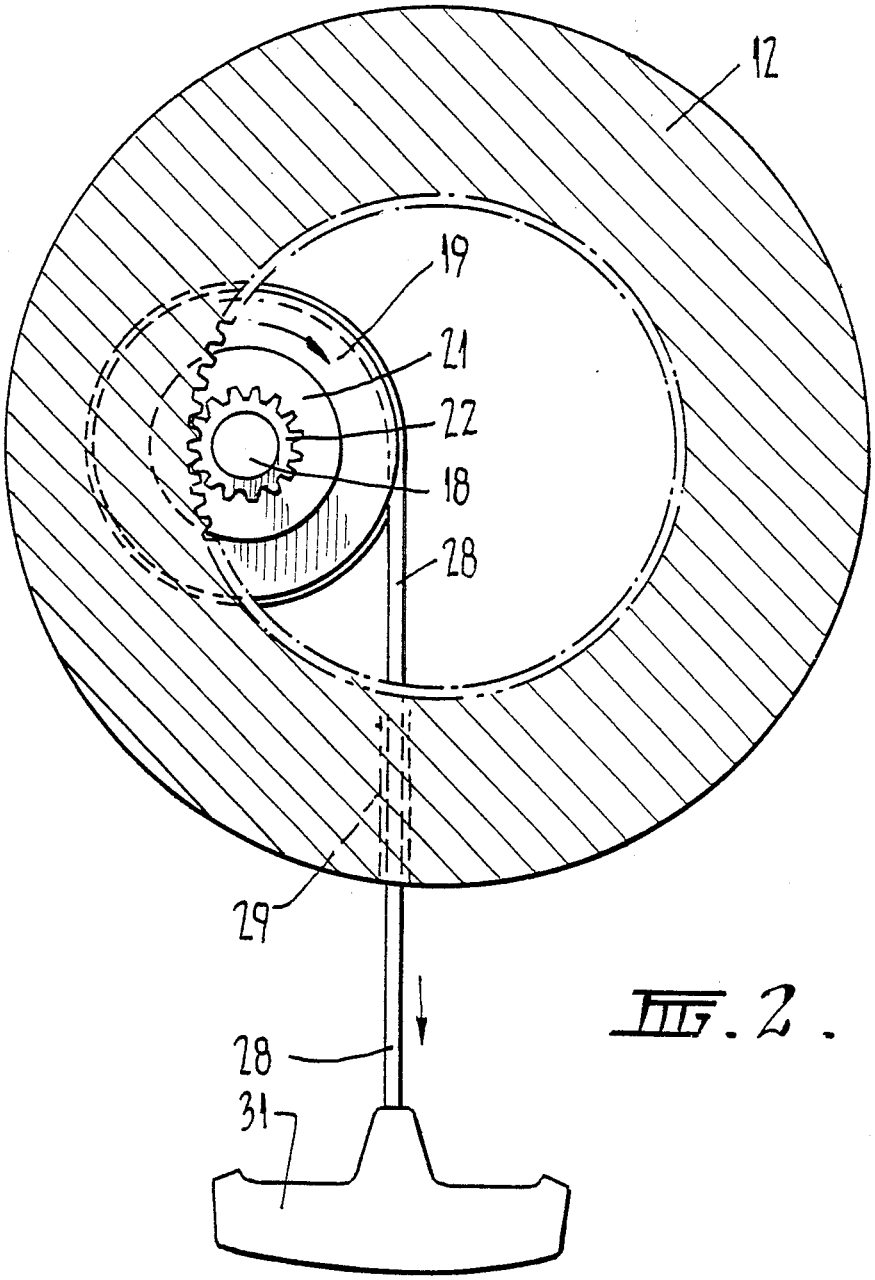
FIG. 2 is a cross-sectional plan view taken along the lines 2—2 of FIG. 1.

Referring to FIGS. 1 and 2 of the drawings, a single speed winch is illustrated having a winch drum 12 mounted for rotation on a base 14 by appropriate ball or roller bearings 16. As will be seen, the winch drum 12 is closed at the top and an O-ring or similar seal is provided between the base of the winch drum 12 and the top of the peripheral wall of the base 14.

The base 14 is provided with a rigid, upstanding post 18 on which is rotatably mounted a pulley 19, a sprag clutch 21 and a pinion 22. The pulley 19 is of the self-recoiling type having an internal spring (not shown) which is tensioned when the pulley is rotated in an operative direction and which then acts to return the pulley to its starter position. The pulley 19 is also provided with a pair of spring loaded pawls 23 which are biased into engagement with serrations 24 on a coaxially mounted ratchet plate 26 which is secured to the body of the sprag clutch 21. Thus, rotation of the pulley 19 in a clockwise direction as viewed in FIG. 2 results in the pawls 23 engaging the serrations 24 to thereby rotate the ratchet plate and sprag clutch 21. The pinion 22 is integral with the body of the sprag clutch 21 and rotates therewith.

The sprag clutch 21, which is of known design, acts on the post 18 so as to rotate only in one direction relative to the post. The sprags (not shown) located within the sprag clutch 21 wedge between the post and the sprag clutch body whenever reverse torque is applied to the sprag clutch body such as, for example, by tension applied to the sheet 27 engaged with the winch drum 12.

An operating cord 28 has one end secured to the pulley 19 and passes out from within the base 14 through the opening 29 and terminates at a handle 31. The cord 28 may have three or more turns about the pulley 19 and is held in the coiled position, with the handle 21 against the side wall of the base 14, by the recoil spring within the pulley 19.

It will be seen that the winch drum can be rotated upon tensioning the cord 28 so as to rotate the pulley 19, the winch drum 12 rotating in a clockwise direction upon rotation of the pulley 19 in an anticlockwise direction as viewed in FIG. 2. Release of the tension on the operating cord 28 causes the rewind spring to rotate the pulley 19 in the opposite direction to rewind the cord thereon. During rewind, the sprag clutch 21 prevents reverse rotation of the winch drum 12.

The ratio between movement of the operating cord 28 and winding of the sheet 27 onto the winch drum 12 is dependent on the diameter of the pulley 19 and the gear ratio between the pinion 22 and the internal gear 17. This ratio may be varied as desired to provide suitable ratio for any particular application of the winch.

Figure 3:
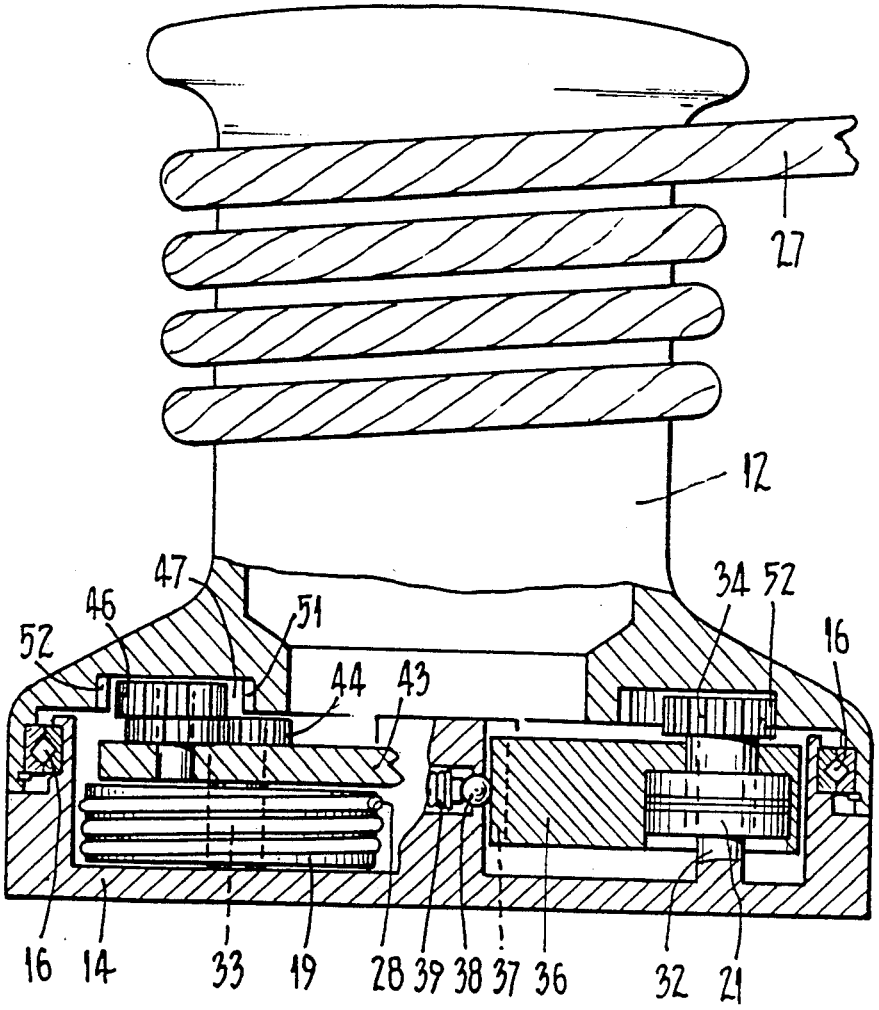
FIG. 3 is a cross-sectional elevational view of a two speed winch in accordance with the invention.
Figure 4:
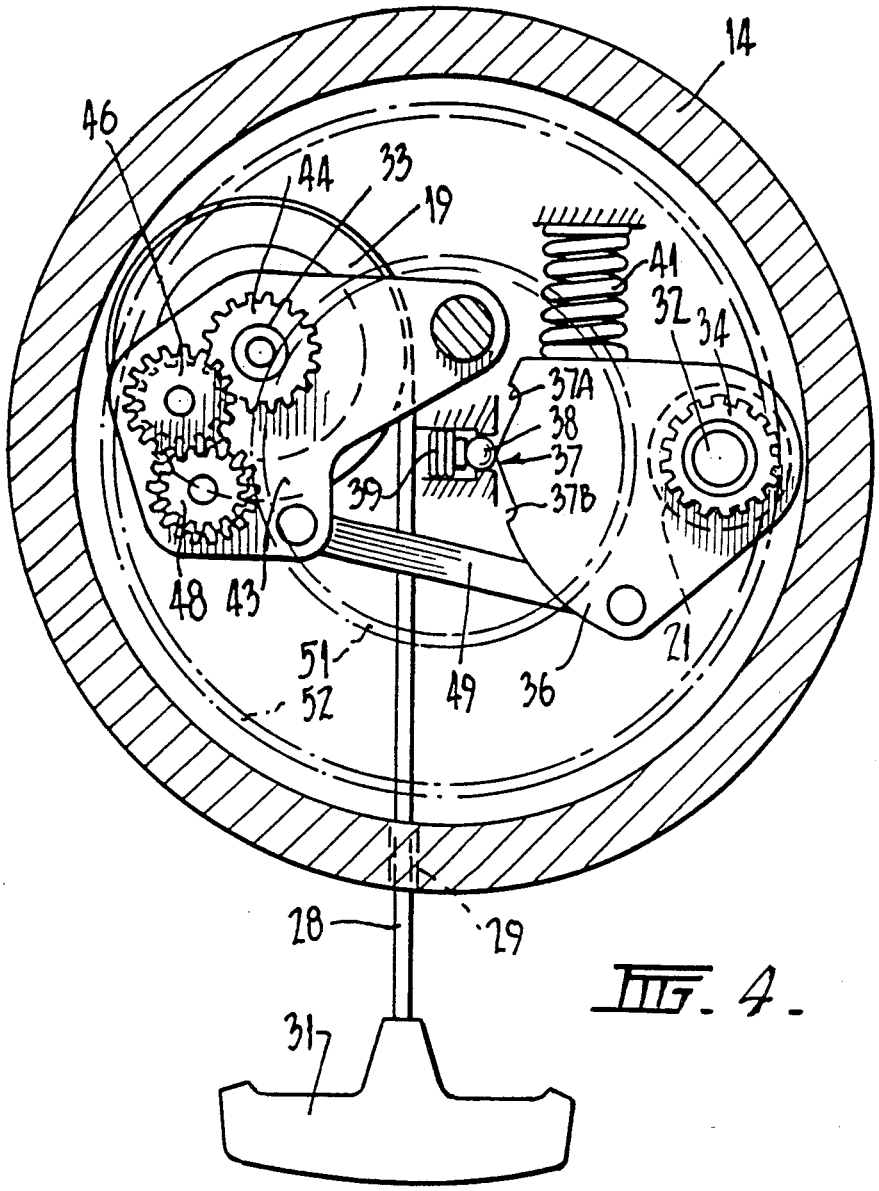
FIG. 4 is a cross-sectional plan view, partly cut away, of the winch of FIG. 3.

Referring now to FIGS. 3 and 4, this construction of winch is somewhat similar to that illustrated in FIGS. 1 and 2 and similar parts will be given the same reference numeral. In this embodiment, the winch drum 12 is mounted on the base 14 by means of a cross tapered roller bearing 16.

In this embodiment, two posts 32 and 33 extend upwardly from the base 14, the post 32 supporting a sprag clutch 21, a pinion gear 34 and a detent plate 36. The sprag clutch 21 of this embodiment has an inner sleeve rotatably mounted on the post 32 and which is integral with the pinion gear 34. The clutch 21 has an outer body part secured to the detent plate 36, the arrangement being such that the pinion gear may rotate in one direction but reverse torque on the pinion gear causes movement of the detent plate about the axis of the post 32.

One edge of the detent plate 36 is formed with a pair of detents 37 one or other of which is adapted to be engaged by the detent ball 38 which is biased towards the detents 37 by spring 39. A loading spring 41 urges the detent plate 36 in an anticlockwise direction about the post 32.

The second post 33 rotatably supports a gear plate 43 which carries three sets of gears 44, 46 and 48. Gear 44 is coaxial with and driven by a pulley 19 which incorporates a self-recoiling spring, ratchet plate and pawls as described in the previous embodiment. Gear 44 meshes with one of the gears of gear set 46 which also meshes with one of the gears of gear set 48. The other gear of each gear set 46 and 48 extends upwardly into an annular gear way 47 formed in the winch drum 12. Both radially inner and radially outer walls of the gear way 47 are formed with gear teeth adapted to mesh with one or other of the gears of the sets 46 and 48.

The gear plate 43 is connected with the detent plate 36 by a gear set rod 49. The length of the rod and the relationship between the gear plate 43 and detent plate 36 is such that, with the spring 39 biasing the detent plate to a position where the detent ball 38 engages detent 37*a*, the gear plate 43 is also rotated in an anticlockwise direction about the post 33 such that the gear set 48 meshes with the radially inner gear 51 on the winch drum 12. Tension applied to the operating cord 28 causes rotation of the pulley 19, the gears 44, 46 and 48 and thus the winch drum 12. Reverse rotation of the winch drum 12 is prevented by the sprag clutch 21 and the detent ball 38 engaged in the detent 37*a* which supports the detent plate in position. If, however, the reverse torque applied to the winch drum is sufficient to overcome the force of the loading spring 39, the detent plate 36 will be moved by movement of the clutch body 21 to a position where the detent ball 38 engages the detent 37*b*. In this position, the gear plate 43 is moved by the rod 49 to a position where the gear 46 engages the radially outer, internal gear 52 on the winch drum 12. The gear ratio is thus increased and further rotation of the winch drum 12 can be effected by operation of the operating cord 28.

If the sheet loading is reduced, the loading spring 39 acts to move the detent plate 36 to its initial position to thereby engage the lower ratio gearing.

It will therefore be seen that the winch of this embodiment provides a two speed winch the gear ratios of which are automatically determined by the loading on the winch drum, the ratios being selected during recoiling of the operating cord onto the pulley 19.

Figure 5:
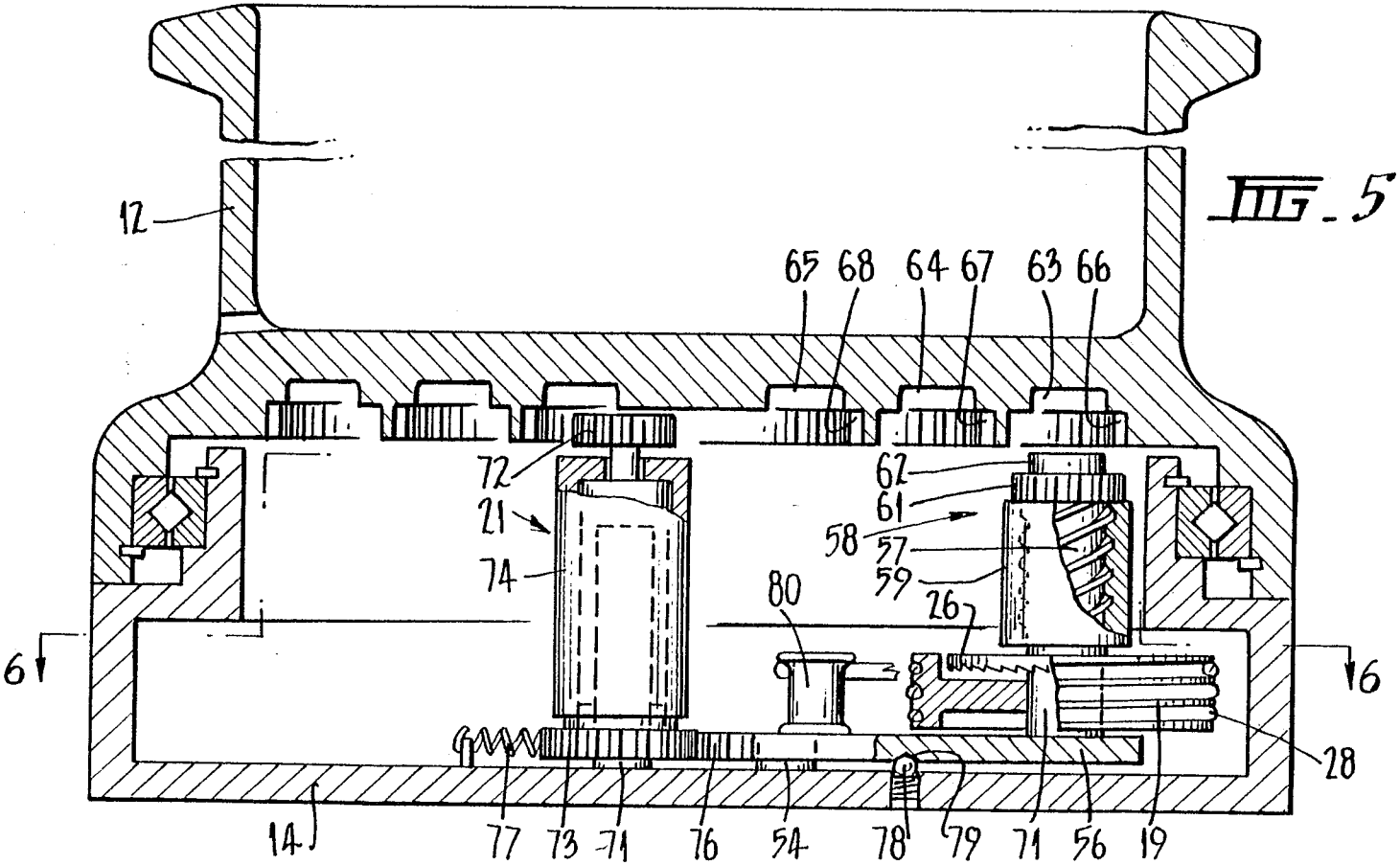
FIG. 5 is a cross-sectional elevational view of a three speed winch in accordance with the invention.
Figure 6:
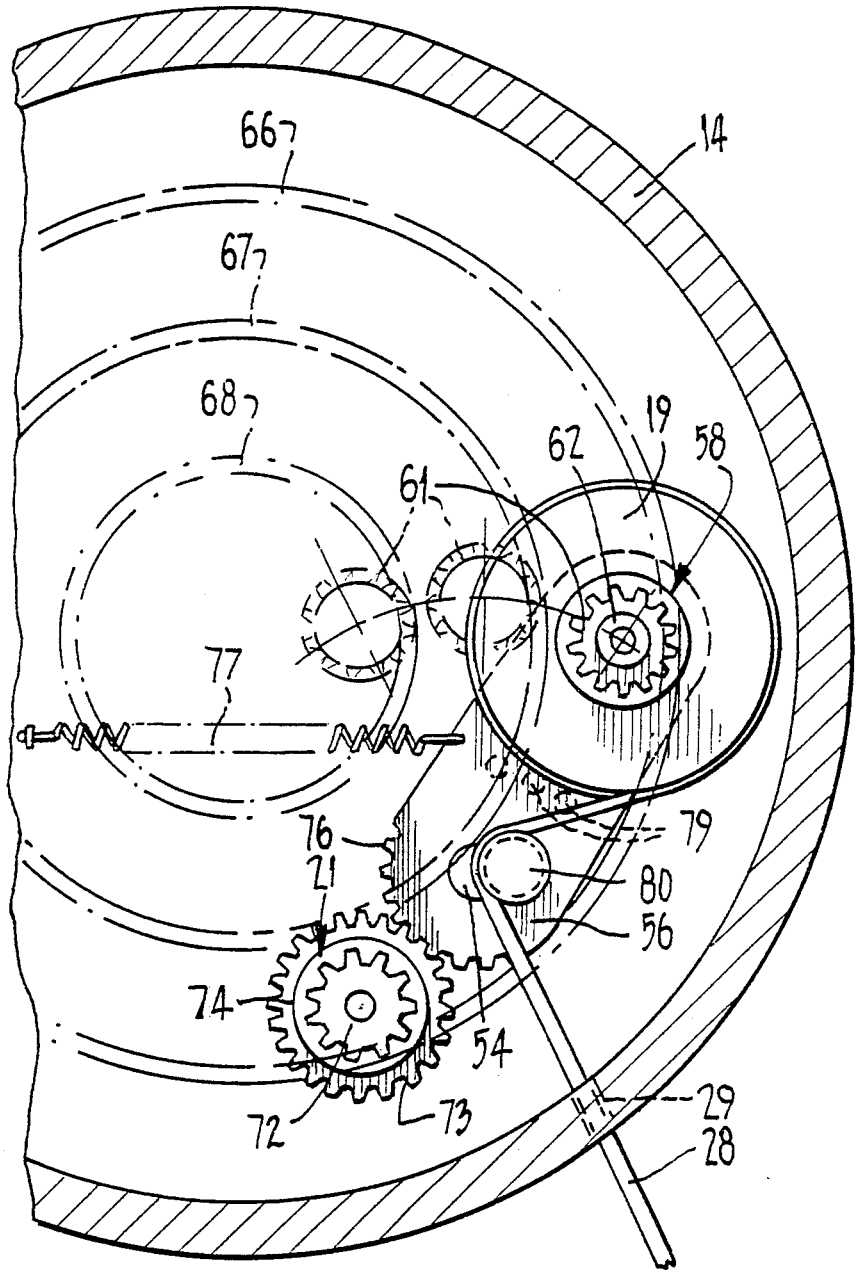
FIG. 6 is a plan view of the winch of FIG. 5 taken along the lines 6—6.

Referring to FIGS. 5 and 6, there is illustrated a three speed winch in which, as in the previous embodiment, the gear ratio is automatically selected in accordance with loading on the winch drum.

In the embodiment illustrated, the winch drum 12 is formed of a hollow shape to facilitate sheet tailing storage. However, the drum may have a closed top as in the previous embodiments if so desired.

As shown in FIG. 5, a relatively short post 54 extending upwardly from the base 14 carries a plate 56 on which is rotatably mounted the pulley 19 and associated recoil-spring, ratchet plate and pawls. The ratchet plate 26 is secured to the track 57 of a Bendix drive 58, the nut 59 of which is fixed to a pinion gear 61 and locating roller bearing 62. The Bendix drive acts to cause the pinion gear 61 and locating bearing 62 to rise relative to the track 57 on rotation of the ratchet plate 26.

The winch drum 12 is provided with three locating tracks 63, 64 and 65 each of which is associated with an internal ring gear 66, 67 and 68 respectively. The locating tracks are adapted to receive the locating bearing 62 when the nut 59 moves upwardly relative to the track 57 and in which position the pinion gear 61 is engaged with the respective ring gear 66, 67 or 68. The different ring gears provide three different gear ratios between rotation of the pulley 19 and rotation of the winch drum 12.

The particular locating track and ring gear selected for engagement by the locating bearing 62 and associated pinion gear 61 is determined by the loading applied to the winch drum 12 which passes from the winch drum 12 through pinion 72, spray clutch 21, spur gear 73 to the plate 56. The sprag clutch 21 is rotatably mounted on a post 71 extending from the base 14 and has a sleeve portion rotatable relative to the post 71 and which is integral with the pinion 72. The outer body 74 of the sprag clutch 21 is fixed to the spur gear 73 which meshes with the segment gear teeth 76 provided on the end of plate 56.

As described with reference to the previous embodiment, tension on the winch drum 12 is carried by the sprag clutch 21 through the pinion 72, the outer body 74 of the clutch being held against rotation by the engagement of the spur gear 73 with the gear teeth 76 on the plate 56. The plate 56 is urged in an anticlockwise direction as seen in FIG. 6 by a tension spring 77. An appropriate stop is provided limiting the anticlockwise rotation of the plate about the axis of the post 54.

In this position, rotation of the pulley 19 causes the Bendix drive to operate to lift the pinion gear 61 into mesh with the ring gear 68. Torque applied to the winch drum 12 by an engaged sheet or the like acts through the pinion 72 sprag clutch 21 and spur gear 73 to urge the plate 56 in a clockwise direction which movement is resisted by the tension spring 77 and a detent 78 located in the base 14 and spring biased into contact with appropriate indentations 79 in the bottom of plate 56. When the torque is sufficient to overcome the detent and spring 77, the plate 56 moves in a clockwise direction until the detent 78 engages the next indentation 79. In this position, the pinion gear 61 is able to engage with the ring gear 67. A further increase in the torque applied to the winch drum causes further rotation of the plate 56 to its outermost position as shown in FIG. 6.

It will be seen that, with this arrangement, any one of three gear ratios is selected automatically dependent on the torque applied to the winch drum 12 by an engaged sheet.

The operating cord 28 passes from the pulley 19 around a guide roller 80 located on the plate 56 in such a way that the cord 28 passes through the axis of the post 54. This prevents the tension in the cord 28 during operation of the winch affecting the location of the plate 56.

Figure 7:
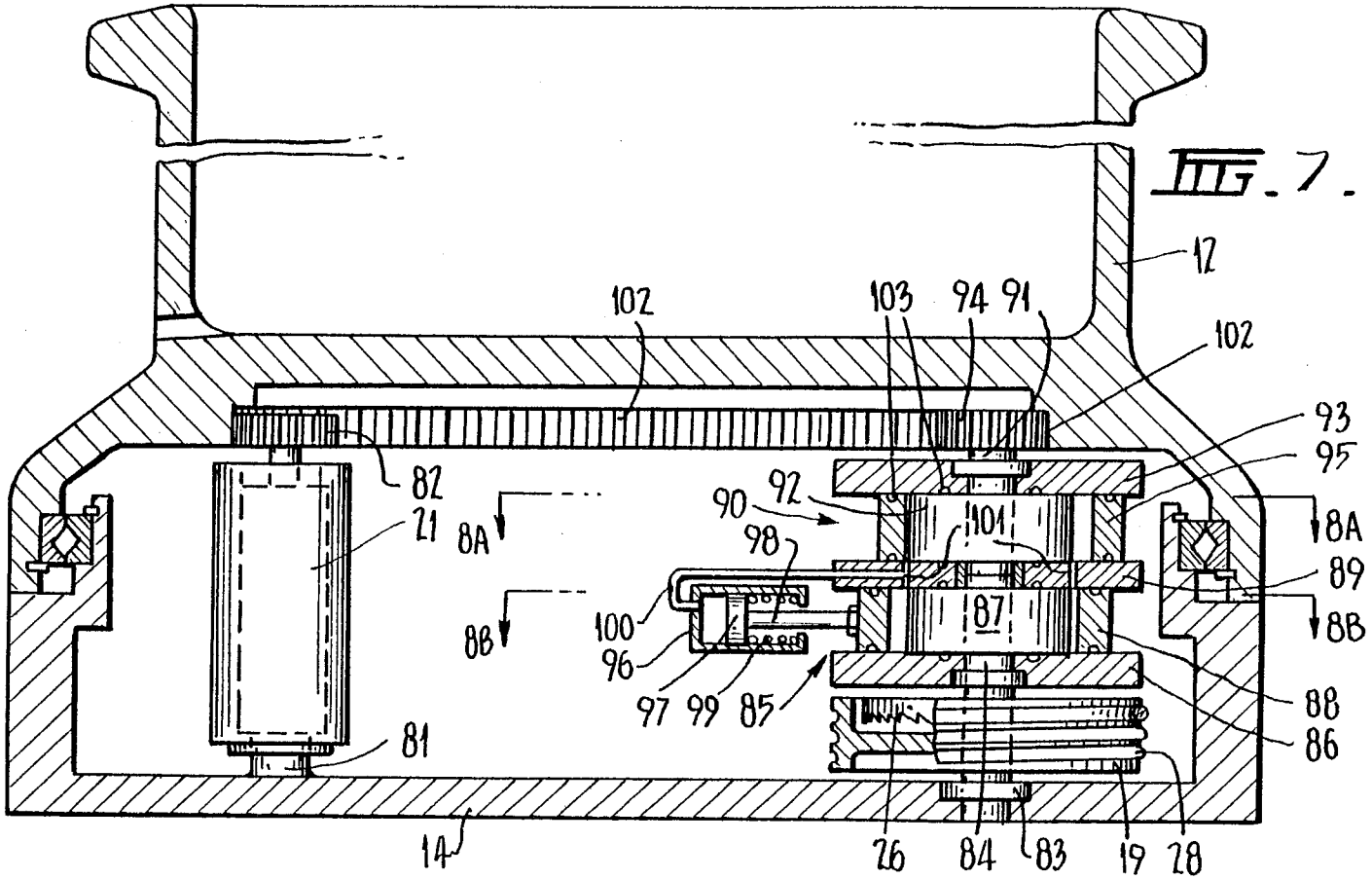
FIG. 7 is a cross-sectional view of a base housing and lower portion of winch drum in accordance with a further embodiment of the invention.

Referring to FIGS. 7 and 8 there is illustrated a further embodiment of the invention utilizing a hydraulic drive system for transmitting rotational movement of the pulley 19 to the winch drum 12 at a ratio dependent on the load on the drum.

In this embodiment, a rigid post 81 extends upwardly from the base 14 adjacent one side thereof and carries a sprag clutch 21 the body of which is connected to a pinion gear 82. The sprags in the sprag clutch 21 act between the clutch body and the post 81 to prevent reverse rotation of the winch drum 12 relative to the base 14.

The base 14 carries a bearing 83 which rotatably supports an input shaft 84 extending substantially vertically. The input shaft 84 rotatably supports a pulley 19 with its associated pawls and a ratchet plate 26 is secured to the input shaft to cause rotation thereof during rotation of the pulley 19 in a given direction.

The input shaft 84 passes through a lower end plate 86 of a hydraulic vane pump 85 the rotor of which is secured to the shaft 84. The pump body 88 is mounted for movement in a plane perpendicular to the axis of the input shaft between the end plate 86 and a valve plate 89 in which the input shaft 84 terminates. An output shaft 91 coaxial with the input shaft 84 extends upwardly from the valve plate 89 through a hydraulic vane motor rotor 92 which is fixed to the output shaft 91, and through an upper end plate 93. A gear pinion 94 is mounted on the upper end of the output shaft 91.

The motor body 95 of the hydraulic motor 90 is fixed relative to the upper end plate 93 and the valve plate 89.

A hydraulic cylinder 96 is positioned adjacent one side of the pump body 88, the cylinder 96 having a piston 97 connected to the pump body 88 by means of a connecting rod 98. A compression spring 99 acts to urge the piston 97 towards the closed end of the cylinder 96. A bleed line 100 connects the closed end of the cylinder 96 with a high pressure outlet from the pump via the valve plate 89.

The valve plate is provided with a plurality of valving apertures 101 to allow hydraulic fluid under pressure to pass from the pump to the motor, and return.

As with previous embodiments, the pinion 94 engages an internal ring gear 102 on the inside of the winch drum 12. Appropriate O-ring seals 103 act to seal the various surfaces of the hydraulic pump and motor to prevent escape of hydraulic fluid therefrom. A reservoir of hydraulic fluid may be provided either in the base of the winch or from a separate, external source.

In operation of the winch of this embodiment, rotation of the pulley 19 by means of the operating cord 28 causes the ratchet plate 26 to drive the input shaft and thereby drive the pump rotor 87. At this time, the compression spring 99 has biased the piston 97 towards the closed end of the hydraulic cylinder 96 thereby moving the pump body 88 to the left-hand side as seen in FIG. 8B. Thus, rotation of the pump rotor 87 results in a relatively large flow of hydraulic fluid which passes through the valving apertures 101 in the valve plates 89 to the hydraulic motor 90. With no load on the winch drum 12, the hydraulic fluid causes rotation of the motor rotor 92 which thereby rotates the pinion 94 and the winch drum 12.

As soon as resistance to rotation of the winch drum 12 is developed by tension applied to a sheet wound therearound, the movement of the rotor 92 is restricted so that the hydraulic pressure in the fluid being pumped to the motor increases. As the pressure increases, greater tension is needed to be applied to the operating cord 28 to rotate the pump rotor 87.

Increased hydraulic pressure passes through the bleed line 100 to the cylinder 96 and when the pressure in the cylinder is sufficient to overcome the force of the compression spring 99, the piston moves the pump body to a position which reduces the volume of fluid pumped thereby. As the hydraulic motor remains at full volume, the ratio between the volumes acts to effectively vary the winching ratio.

As with the previous embodiments, on release of the operating cord 28, the sprag clutch 21 acts to prevent reverse rotation of the winch drum 12.

It will be seen that the effective changing of gear ratio with the hydraulic system of this embodiment operates during application of tension to the operating cord and rotation of the pulley 19 as compared to the previous embodiments in which the ratio changing was effected on release of tension in the operating cord. Naturally, if necessary, the pulley 19 and associated pawls and ratchet plate may be mounted separately from the hydraulic pump and motor and may be connected thereto by appropriate gearing so that the pump rotor is driven at a speed commensurate with proper operation of the hydraulic system.

Although the embodiments have been described in relation to the use of an operating cord and pulley, it will be appreciated that an appropriate cable or chain may be used in place of a cord and that, in the case of a chain, the pulley may be replaced by an appropriate sprocket.

The winches illustrated and described above may be modified to selectively permit reverse rotation of the winch drum 12 so that a sheet may be released without unwinding the sheet from the drum. For this purpose, means may be provided to either disrupt the sprag clutch function or to disengage the pinion associated with the sprag clutch from the winch drum gear. Thus, an arm or lever mounted on the outer surface of the base housing can be manually movable, against a detent or biasing spring, to physically move the pinion out of engagement with the associated winch drum gear thereby removing the locking effect of the sprag clutch against reverse rotation of the winch drum.

With the embodiment illustrated in FIGS. 7, 8A, and 8B, a fluid control valve may be used to control fluid flow from the motor to the pump thereby effectively controlling the reverse rotation of the winch drum.

The winch of the present invention may be used with self-tailing devices as known in the art. Further, those skilled in the art will appreciate that many changes in construction and widely differing embodiments and applications of the invention will suggest themselves without departing from the spirit and scope of the invention. The disclosures and description herein are purely illustrative and are not intended to be in any sense limiting.

I claim:

1. A winch of the type including a base housing, a winch drum rotatably mounted on said base housing and means to rotate said winch drum relative to said base housing, comprising:

(a) a spring biased recoiling, peripherally driven, rotatable means, (b) an elongate, flexible operating means engaged about said driven, rotatable means to cause rotation thereof, said elongate, flexible operating means passing through an opening in said base housing, (c) drive means operative to interconnect said driven, rotatable means with said winch drum to rotate said winch drum in a given direction on rotation of said driven, rotatable means resulting from application of tension to said elongate, flexible operating means, (d) said drive means including means to vary the ratio between rotational movement of the driven, rotatable means and rotational movement imparted thereby to the winch drum, (e) load sensing means adapted to operate said ratio varying means automatically in accordance with load torque applied to said winch drum tending to rotate said drum in a direction opposite said given direction, (f) first unidirectional means operatively located between said winch drum and said base housing for permitting rotation of said winch drum in said given direction only, and (g) second unidirectional means associated with said driven, rotatable means for permitting recoiling of said elongate, flexible operating means while said first unidirectional means holds the winch drum against rotation in a direction opposite said given direction.

2. A winch according to claim 1 wherein said winch drum has two or more gear rings coaxial with the drum axis, said driven, rotatable means and said second unidirectional means being mounted coaxially on a gear plate pivoted relative to said base housing, driving gear means drivingly connected to said second unidirectional means and movable to engage with one of said winch drum gear rings in a first predetermined pivot position of said gear plate to rotate said winch drum in said given direction at a first predetermined gear ratio and to engage with another of said winch drum gear rings in another predetermined pivot position of said gear plate to rotate said winch drum in said given direction at a second predetermined gear ratio and said load sensing means is operative to move said gear plate between said predetermined pivot positions.

3. A winch according to claim 2 wherein said driving gear means includes means to move a pinion gear into mesh with a selected one of said winch drum gear rings, the pinion gear having an associated guide bearing to engage a respective one of a plurality of guide tracks adjacent the gear rings.

4. A winch according to claim 3, wherein said first unidirectional means comprises a clutch having a first part connected to a gear engaged with one of said winch drum gear rings, a second part connected to said gear plate and biasing means to bias said gear plate to one of said predetermined pivot positions, wherein said first clutch part rotates relative to said second part during rotation of said winch drum in said given direction but said first and second parts lock together to prevent reverse rotation, and said clutch transmits load torque applied to said winch drum to said gear plate for urging said gear plate against said biasing means.

5. A winch according to claim 2 wherein said first unidirectional means comprises a clutch having a first part connected to a gear engaged with one of said winch drum gear rings, a second part connected to said gear plate and biasing means to bias said gear plate to one of said predetermined pivot positions, wherein said first clutch part rotates relative to said second part during rotation of said winch drum in said given direction but said first and second parts lock together to prevent reverse rotation, and said clutch transmits load torque applied to said winch drum to said gear plate for urging said gear plate against said biasing means.

6. A winch according to claim 1 wherein said winch drum has an internal gear and a radially smaller ring gear both coaxial with the drum axis, and said driven, rotatable means, said second unidirectional means and a driving pinion are mounted coaxially on a gear plate pivoted relative to said base housing, said gear plate carrying at least two meshed drive gears one of which is meshed with said driving pinion, a first of said drive gears being movable to mesh with said internal gear of said winch drum in a first pivot position of said gear plate and the other drive gear being movable to mesh with said ring gear in a second pivot position of said gear plate, and said ratio varying means comprises a detent plate connected with said first unidirectional means and a gear set rod interconnecting the detent plate and the gear plate, the detent plate being movable for moving the gear plate between said first and said second positions.

7. A winch according to claim 6, wherein said load sensing means includes spring means for biasing said detent plate to a high ratio position, a pair of detents formed on said detent plate and a spring biased detent ball which engages one of the detents in said high ratio position, wherein load torque applied to said winch drum and tending to rotate the drum in a direction opposite said given direction is transmitted by said first unidirectional means to said detent plate for urging said detent plate to move against a biasing force of the spring means.

8. A winch according to claim 1 wherein said drive means includes a hydraulic pump operatively connected to said driven, rotatable means via said second unidirectional means, hydraulic motor means driven by fluid pressure from said hydraulic pump and connected to a drive pinion which is meshed with a gear on said winch drum.

9. A winch according to claim 8 wherein means are provided to vary the fluid volume delivered by said hydraulic pump to said hydraulic motor means in response to load on the winch drum.

10. A winch according to claim 8 or claim 9 wherein said hydraulic motor means is a vane motor the rotor of which is directly coupled to said drive pinion and the body of said motor is fixed relative to the rotor axis.

11. A winch according to claim 10 wherein said hydraulic pump is a vane pump having a rotor axis coaxial with the vane motor rotor axis, the body of said pump being movable transversely to vary the volume of fluid delivered by said pump dependent on the load on said motor, a valve plate being located between the pump and motor and provided with fluid passageways by which hydraulic fluid passes to the motor from the pump, and returns, and a hydraulic cylinder and piston means is connected to said pump body and receives a supply of hydraulic fluid from the high pressure outlet of the pump to move the pump body against biasing means.

12. A winch according to claim 1, wherein said first unidirectional means comprises a sprag clutch.

13. A winch according to claim 1, wherein said second unidirectional means comprises a ratchet plate mounted coaxially with said driven, rotatable means, a plurality of axially extending ratchet teeth arranged on one face of the ratchet plate and one or more spring loaded pawls pivotally mounted on the driven, rotatable means.

14. A winch according to claim 1, wherein said driven, rotatable means comprises a pulley adapted to receive a plurality of turns of said operating cord, said pulley having a recoil spring biasing the pulley to rotate in a direction to rewind the cord thereon.

15. A winch according to claim 1, wherein the outer surface of the winch drum is co-extensive above the base housing.

* * * * *